US010512581B2

(12) United States Patent
Lan et al.

(10) Patent No.: US 10,512,581 B2
(45) Date of Patent: Dec. 24, 2019

(54) SHOULDER JOINT REHABILITATION ASSISTIVE DEVICE

(71) Applicant: NATIONAL CHENG KUNG UNIVERSITY, Tainan (TW)

(72) Inventors: Chao-Chieh Lan, Tainan (TW); Hsiang-Chien Hsieh, Tainan (TW); Li Chien, Tainan (TW); Dian-Fu Chen, Tainan (TW)

(73) Assignee: National Cheng Kung University, Tainan (TW)

( * ) Notice: Subject to any disclaimer, the term of this patent is extended or adjusted under 35 U.S.C. 154(b) by 400 days.

(21) Appl. No.: 15/393,724

(22) Filed: Dec. 29, 2016

(65) Prior Publication Data

US 2017/0189257 A1 Jul. 6, 2017

(30) Foreign Application Priority Data

Jan. 5, 2016 (TW) ..... 105100204 A

(51) Int. Cl.
*A61H 1/02* (2006.01)
*A63B 21/02* (2006.01)
(Continued)

(52) U.S. Cl.
CPC ..... *A61H 1/0281* (2013.01); *A63B 21/00178* (2013.01); *A63B 21/00181* (2013.01);
(Continued)

(58) Field of Classification Search
CPC ..... A61H 3/00; A61H 2201/165; A61H 2201/5061; A61H 2201/5069; A61H 2201/1614; A61H 2201/163; A61H 2201/5058; A61H 2201/1246; A61H 1/0274; A61H 2201/1463; A61H 2201/1635; A61H 2201/1645; A61H 2201/5079; A61H 1/0281; A61H 2201/5071; A61H 2205/06; A61H 1/005; A61H 1/006; A61H 2205/062;
(Continued)

(56) References Cited

U.S. PATENT DOCUMENTS 9,427,865 B2 * 8/2016 Doyle ..... F16M 13/04
2006/0206043 A1 * 9/2006 Yakimovich ..... A61F 5/0125 602/16
2016/0339583 A1 * 11/2016 Van Engelhoven ... B25J 9/0006

* cited by examiner

*Primary Examiner* — Ann Schillinger
(74) *Attorney, Agent, or Firm* — Rosenberg, Klein & Lee

(57) ABSTRACT

A shoulder joint rehabilitation assistive device has an exoskeleton base, an actuating mechanism, a spherical mechanism, and an upper limb connecting mechanism. The actuating mechanism is mounted on the exoskeleton base and has a yaw spring actuating assembly and a pitch spring actuating assembly. The spherical mechanism is connected with the actuating mechanism and has a linking rod, a spherical yaw linking assembly, and a spherical pitch linking assembly. The linking rod is pivotally connected with the exoskeleton base. The spherical yaw linking assembly has two ends respectively provided with a first yaw actuating portion and a second yaw actuating portion. The spherical pitch linking assembly has two ends respectively provided with a first pitch actuating portion and a second pitch actuating portion. The upper limb connecting mechanism is connected with the linking rod and the second yaw actuating portion of the spherical yaw linking assembly.

20 Claims, 13 Drawing Sheets

(51) Int. Cl.

| | |
|---|---|
| ***A63B 21/05*** | (2006.01) |
| ***A63B 21/00*** | (2006.01) |
| *A63B 24/00* | (2006.01) |

(52) U.S. Cl.

CPC ..... *A63B 21/023* (2013.01); *A63B 21/05* (2013.01); *A63B 21/4005* (2015.10); *A63B 21/4017* (2015.10); *A63B 21/4049* (2015.10); *A61H 2201/0157* (2013.01); *A61H 2201/12* (2013.01); *A61H 2201/165* (2013.01); *A61H 2201/1614* (2013.01); *A61H 2201/5007* (2013.01); *A61H 2201/5061* (2013.01); *A61H 2201/5064* (2013.01); *A63B 21/00069* (2013.01); *A63B 24/0087* (2013.01); *A63B 2220/20* (2013.01); *A63B 2220/803* (2013.01)

(58) Field of Classification Search

CPC ..... A63B 21/00181; A63B 2022/0094; A63B 21/0004; A63B 21/00178; A63B 21/0058; A63B 21/15; A63B 21/40; A63B 21/4007; A63B 21/4035; A63B 21/4039; A63B 21/4043; A63B 21/4049; A63B 2220/51; A63B 23/035

See application file for complete search history.

SHOULDER JOINT REHABILITATION ASSISTIVE DEVICE

BACKGROUND OF THE INVENTION

1. Field of the Invention

The present invention relates to a rehabilitation assistive device, and more particularly to a shoulder joint rehabilitation assistive device.

2. Description of Related Art

To assist a person disabled in upper limbs to support or guide the arms, to reduce the load applied to the arms due to gravity, or to increase the movement range of the arms for shoulder/arm rehabilitation, limb or shoulder rehabilitation devices are provided.

The conventional upper limb rehabilitation device has a series connection structure and comprises a body and multiple arms connected with each other in series and connected with the body. Each pair of connecting arms has a rotating actuator mounted at a joint between the two connecting arms. The arms are connected with an upper limb of a user with connected belts, such that the upper limb or shoulder of the user can be guided to exercise by the rotating actuators.

However, the conventional upper limb rehabilitation device has the following drawbacks.

1. The conventional upper limb rehabilitation device has a series connection structure, so the conventional upper limb rehabilitation device is large in volume, is not portable, and is inconvenient in use.

2. The conventional upper limb rehabilitation device has a series connection structure having multiple joints and each joint has a rotating actuator, so the density of the torque of the conventional upper limb rehabilitation device is low. Thus, a torque amplifier is necessary for amplifying the torque, so the conventional upper limb rehabilitation device is complicated in structure.

3. To control the force or resistance of using the conventional upper limb rehabilitation device, a remote multi-axis detecting device and a control system are necessary. However, the multi-axis detecting device costs high, so the conventional upper limb rehabilitation device is expensive.

4. The actuators of the conventional upper limb rehabilitation device are motors, so the upper limb can only be actuated to move unidirectionally. The user cannot move the upper limb in reverse, so the conventional upper limb rehabilitation device is not versatile in use.

5. The conventional upper limb rehabilitation device is connected with an upper limb of a user by belts, but the belts will limit the movement of the upper limb of the user. Thus, the freedom of using the conventional upper limb rehabilitation device is insufficient, and this will cause discomfort to the user.

To overcome the shortcomings, the present invention tends to provide a shoulder joint rehabilitation assistive device to mitigate or obviate the aforementioned problems.

SUMMARY OF THE INVENTION

The main objective of the invention is to provide a shoulder joint rehabilitation assistive device that has a simplified structure, is portable, and costs low.

The shoulder joint rehabilitation assistive device has an exoskeleton base, an actuating mechanism, a spherical mechanism, and an upper limb connecting mechanism. The exoskeleton base has a securing board and an arm disposed on the securing board. The actuating mechanism is mounted on the securing board of the exoskeleton base and has a yaw spring actuating assembly and a pitch spring actuating assembly. The yaw spring actuating assembly is mounted on the securing board and has a first linear actuator and a first spring actuating portion. The first linear actuator has a first linear actuating portion. The first spring actuating portion is connected with the first linear actuating portion in series. The pitch spring actuating assembly is mounted on the securing board and has a second linear actuator and a second spring actuating portion. The second linear actuator has a second linear actuating portion. The second spring actuating portion is connected with the first linear actuating portion in series. The spherical mechanism is connected with the actuating mechanism and has a linking rod, a spherical yaw linking assembly, and a spherical pitch linking assembly. The linking rod is pivotally connected with the arm of the exoskeleton base. The spherical yaw linking assembly has two ends respectively provided with a first yaw actuating portion and a second yaw actuating portion. The first yaw actuating portion is connected with a first spring actuating portion of the yaw spring actuating assembly in series. The second yaw actuating portion is pivotally connected with a lower portion of the linking rod. The spherical pitch linking assembly is disposed below the spherical yaw linking assembly and has two ends respectively provided with a first pitch actuating portion and a second pitch actuating portion. The first pitch actuating portion is connected with a second spring actuating portion of the pitch spring actuating assembly in series. The second pitch actuating portion is connected pivotally with a lower portion of the linking rod. The upper limb connecting mechanism is connected with the linking rod and the second yaw actuating portion of the spherical yaw linking assembly.

Other objects, advantages and novel features of the invention will become more apparent from the following detailed description when taken in conjunction with the accompanying drawings.

DETAILED DESCRIPTION OF PREFERRED EMBODIMENT

Figure 1:
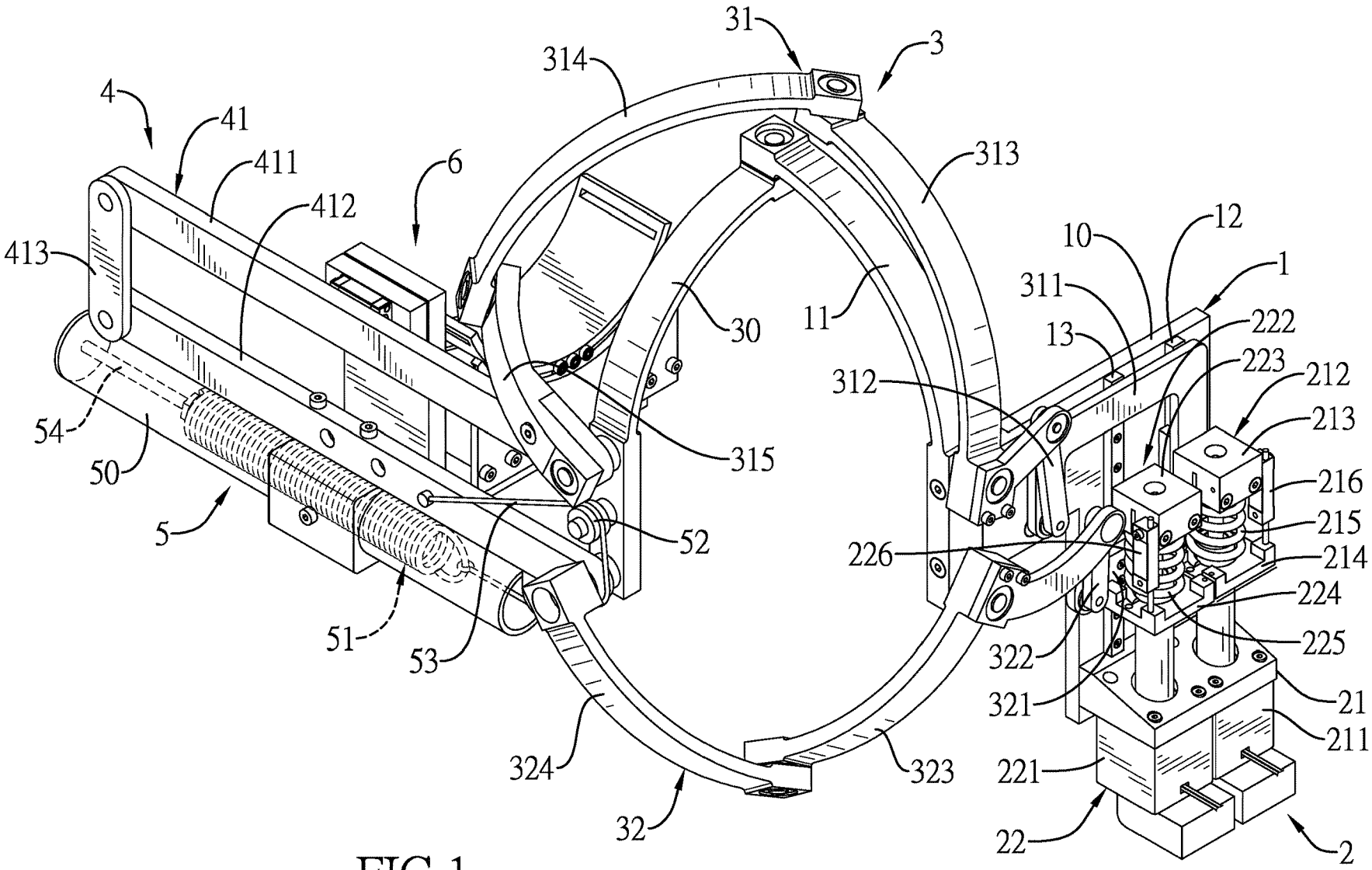
FIG. 1 is a perspective view of a shoulder joint rehabilitation assistive device in accordance with the present invention.
Figure 2:
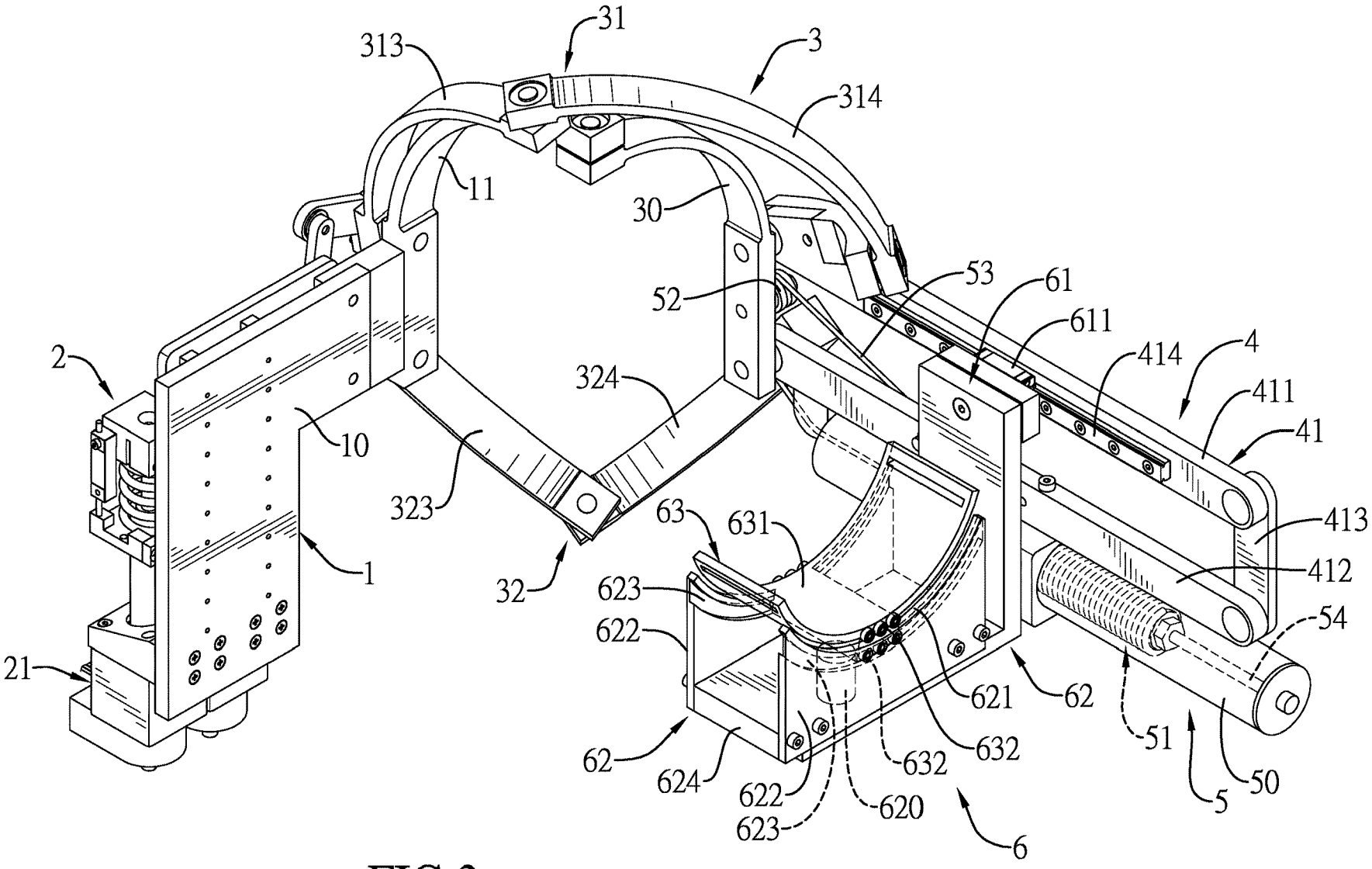
FIG. 2 is another perspective view of the shoulder joint rehabilitation assistive device in FIG. 1.

With reference to FIGS. 1 and 2, a shoulder joint rehabilitation assistive device in accordance with the present invention comprises an exoskeleton base 1, an actuating mechanism 2, a spherical mechanism 3, and an upper limb connecting mechanism 4.

Figure 3:
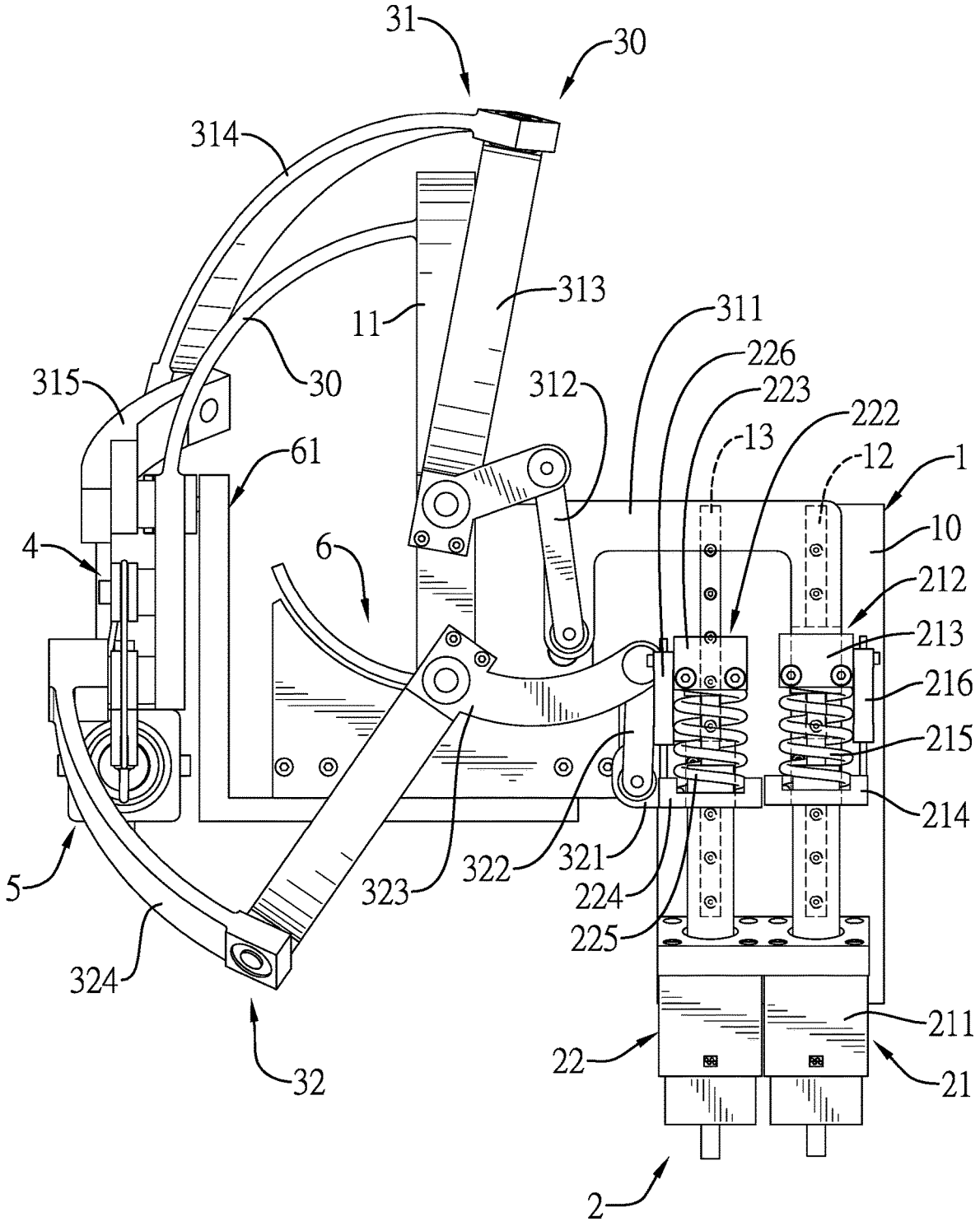
FIG. 3 is a side view of the shoulder joint rehabilitation assistive device in FIG. 1.

With reference to FIGS. 1 and 3, the exoskeleton base 1 comprises a securing board 10 and an arm 11 disposed on the securing board 10. In the present embodiment, the arm 11 is mounted on a side of the securing board 10 and is curved. Two longitudinal rails 12,13 are mounted on the securing board 10 and are parallel with each other.

The actuating mechanism 2 is mounted on the securing board 10 of the exoskeleton base 1 and comprises a yaw spring actuating assembly 21 and a pitch spring actuating assembly 22. The yaw spring actuating assembly 21 is mounted on the securing board 10 and comprises a first linear actuator 211 and a first spring actuating portion 212. The first linear actuator 211 has a first linear actuating portion. The first spring actuating portion 212 is connected with the first linear actuating portion in series. The pitch spring actuating assembly 22 is mounted on the securing board 10 and comprises a second linear actuator 221 and a second spring actuating portion 222. The second linear actuator 221 has a second linear actuating portion. The second spring actuating portion 222 is connected with the second linear actuating portion in series. Preferably, the first linear actuator 211 and the second linear actuator 221 may be linear motors or equivalent linear driving devices.

In the present embodiment, the first linear actuator 211 is a linear motor. The first linear actuating portion is capable of moving upward and downward. The first spring actuating portion 212 comprises a first actuating block 213, a first driving block 214, and a first spring 215. The first actuating block 213 is connected securely with the first linear actuating portion of the first linear actuator 211. The first driving block 214 is located below the first actuating block 213. The first linear actuating portion is mounted through a through hole defined through the first driving block 214. The first spring 215 is mounted between the first actuating block 213 and the first driving block 214 and is mounted around the first linear actuating portion.

The second linear actuator 221 of the pitch spring actuating assembly 22 is juxtaposed to the first linear actuator 211 of the yaw spring actuating assembly 21. The second linear actuator 221 is a linear motor. The second linear actuating portion is capable of moving upward and downward. The second spring actuating portion 222 comprises a second actuating block 223, a second driving block 224, and a second spring 225. The second actuating block 223 is connected securely with the second linear actuating portion of the second linear actuator 221. The second driving block 224 is located below the second actuating block 223. The second linear actuating portion is mounted through a through hole defined through the second driving block 224. The second spring 225 is mounted between the second actuating block 223 and the second driving block 224 and is mounted around the second linear actuating portion.

In addition, the yaw spring actuating assembly 21 further comprises a first movement sensor 216 mounted on the first spring actuating portion 212 to detect a degree of deformation of the first spring 215. The pitch spring actuating assembly 22 further comprises a second movement sensor 226 mounted on the second spring actuating portion 222 to detect a degree of deformation of the second spring 225. With the degrees of deformation of the springs 215,225 are detected, the forces provided by the springs 215,225 can be calculated by a computer. Preferably, the movement sensors 216,226 may be potentiometers. The first movement sensor 216 is mounted between the first actuating block 213 and the first driving block 214 to detect the distance between the first actuating block 213 and the first driving block 214. The change of the distance between the first actuating block 213 and the first driving block 214 refers to the degree of deformation of the first spring 215. Accordingly, the degree of deformation of the first spring 215 is detected.

The second movement sensor 226 is mounted between the second actuating block 223 and the second driving block 224 to detect the distance between the second actuating block 223 and the second driving block 224. The change of the distance between the second actuating block 223 and the second driving block 224 refers to the degree of deformation of the second spring 225. Accordingly, the degree of deformation of the second spring 225 is detected.

With reference to FIGS. 1 to 4, the spherical mechanism 3 is connected with the actuating mechanism 2 and comprises a linking rod 30, a spherical yaw linking assembly 31, and a spherical pitch linking assembly 32. The linking rod 30 is pivotally connected with the arm 11 of the exoskeleton base 1. The spherical yaw linking assembly 31 has two ends respectively provided with a first yaw actuating portion and a second yaw actuating portion. The first yaw actuating portion is connected with the first spring actuating portion 212 of the yaw spring actuating assembly 21 in series. The second yaw actuating portion is pivotally connected with a lower portion of the linking rod 30. The spherical pitch linking assembly 32 is disposed below the spherical yaw linking assembly 31 and has two ends respectively provided with a first pitch actuating portion and a second pitch actuating portion. The first pitch actuating portion is connected with the second spring actuating portion 222 of the pitch spring actuating assembly 22 in series. The second pitch actuating portion is pivotally connected with the lower portion of the linking rod 30.

Preferably, the linking rod 30 is curved. The spherical yaw linking assembly 31 comprises a first yaw lever 311, a second yaw lever 312, a third yaw lever 313, a fourth yaw lever 314, and a fifth yaw lever 315 pivotally connected with each other in series. The fourth yaw lever 314 and the fifth yaw lever 315 are curved. The first yaw lever 311 is mounted upward and downward moveably on the securing board 10 of the exoskeleton base 1. Preferably, the first yaw lever 311 is mounted on and is moveable relative to the longitudinal rail 12. The first yaw actuating portion is defined at an end of the first yaw lever 311 opposite the second yaw lever. 312 The third yaw lever 313 is L-shaped and has a bent segment pivotally connected with the securing board 10 at a position adjacent to the arm 11. The second yaw actuating portion is defined at an end of the fifth yaw lever 315 opposite the fourth yaw lever 314.

The spherical pitch linking assembly 32 comprises a first pitch lever 321, a second pitch lever 322, a third pitch lever 323, and a fourth pitch lever 324 pivotally connected with each other in series. The fourth pitch lever 324 is curved and is below the arm 11 and the linking rod 30. The first pitch lever 321 is mounted upward and downward moveably on the securing board 10 of the exoskeleton base 1. Preferably, the first pitch lever 321 is mounted on the longitudinal rail 13 on the securing board 10. The first pitch actuating portion is defined at an end of the first pitch lever 321 opposite the second pitch lever 322. The third pitch lever 323 is L-shaped and has a bent segment bent reversely relative to the third yaw lever 313. The bent segment of the third pitch lever 323 is pivotally connected with the securing board 10 at a position adjacent to the arm 11 and is located below the bent segment of the third yaw lever 313. The second pitch actuating portion is defined at an end of the fourth pitch lever 324 opposite the third pitch lever 323.

Figure 4:
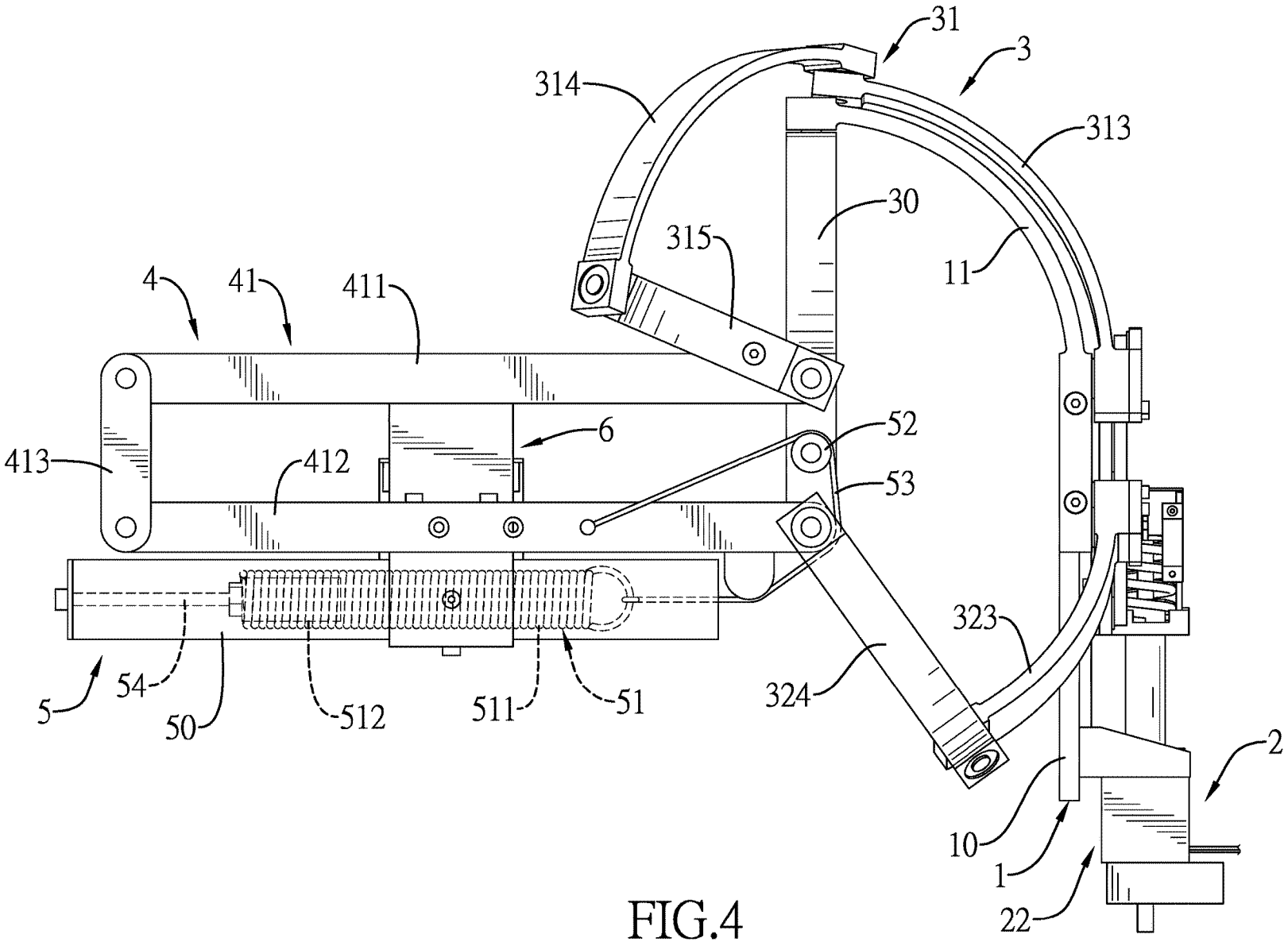
FIG. 4 is a front view of the shoulder joint rehabilitation assistive device in FIG. 1.

With reference to FIGS. 1, 2 and 4, the upper limb connecting mechanism 4 is connected with the linking rod 30 and the second yaw actuating portion of the spherical yaw linking assembly 31. The upper limb connecting mechanism 4 comprises an upper limb connecting lever assembly 41. The upper limb connecting lever assembly 41 comprises an upper lever 411, a lower lever 412, and a side lever 413. The upper lever 411 has an end connected securely with the second yaw actuating portion of the spherical yaw linking assembly 31 and is pivotally connected with the lower portion of the linking rod 30 at a position where the second yaw actuating portion is pivotally connected with the lower portion of the linking rod 30. The lower lever 412 is parallel with the upper lever 411 and has an end pivotally connected with the lower portion of the linking rod 30 at a position where the second pitch actuating portion is pivotally connected with the lower portion of the linking rod 30. The side lever 413 is pivotally connected between the upper lever 411 and the lower lever 412 in series.

In practice, the upper limb connecting lever assembly 41 is connected with an upper limb of a user with elastic belts, adhesive straps, fastening straps or combination of the belts and straps. Thus, the upper lever 411 and the lower lever 412 can be connected with the upper limb of the user, and the upper limb of the user can move with the upper limb connecting lever assembly 41.

In addition, the shoulder joint rehabilitation assistive device may further comprise an upper limb adaptive mechanism 6 to connect the upper limb of the user. The upper limb adaptive mechanism 6 may be a slidable mechanism, a rotatable mechanism, or a slidable and rotatable mechanism as shown in FIGS. 2, 5, and 6 with degree of freedom to adapt to the movement and rotation of the upper limb of the user.

Figure 5:
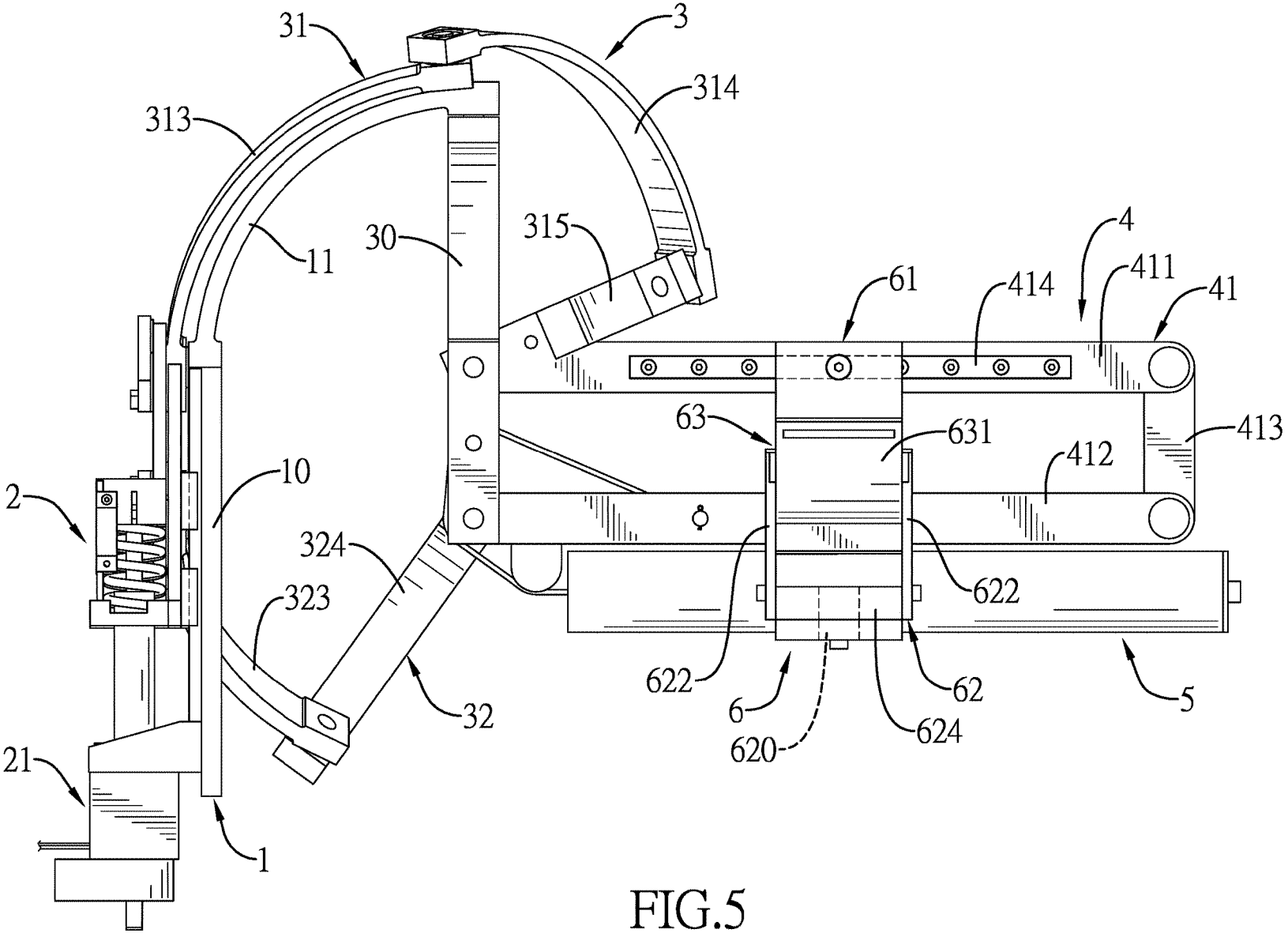
FIG. 5 is a rear view of the shoulder joint rehabilitation assistive device in FIG. 1.
Figure 6:
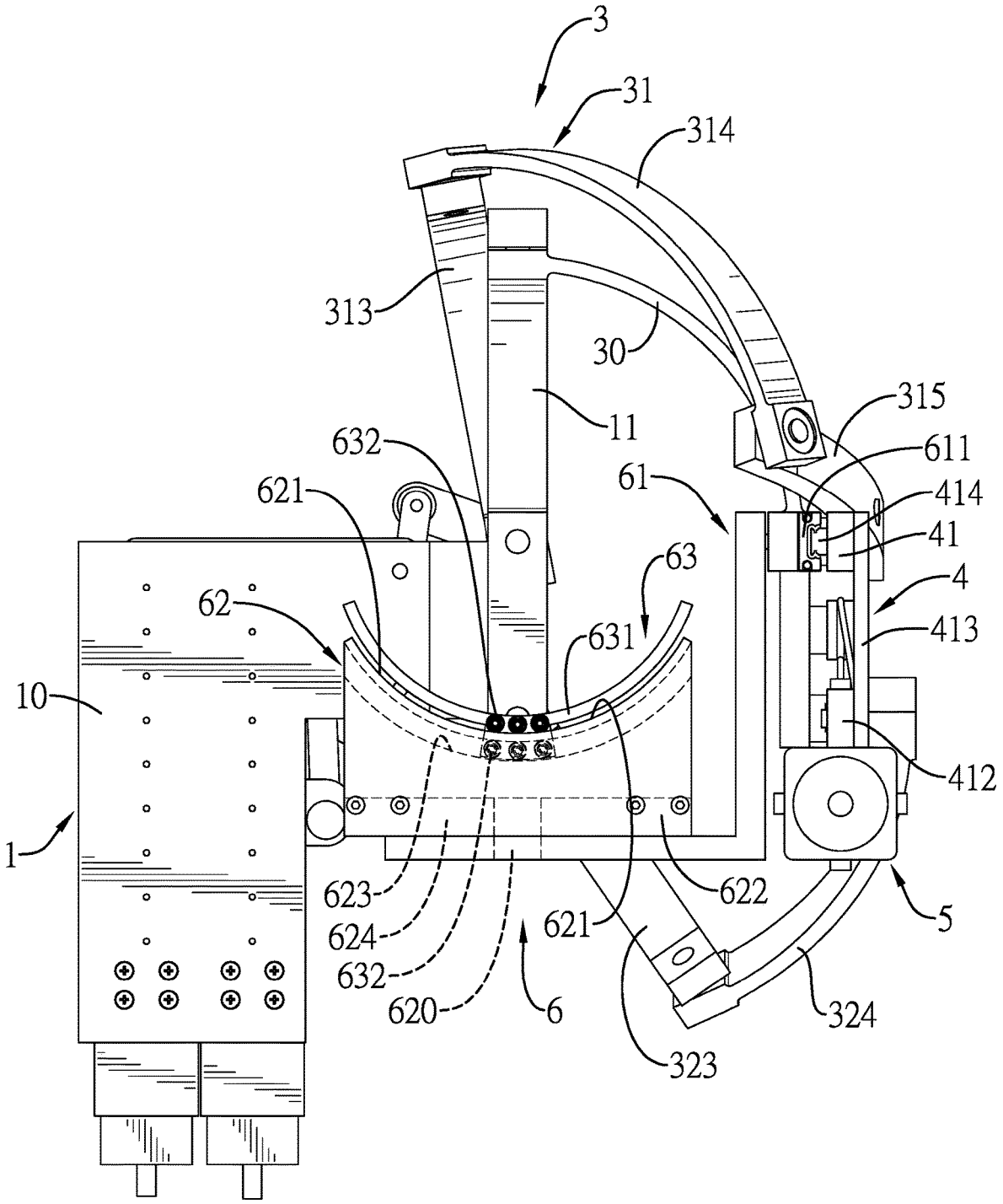
FIG. 6 is another side view of the shoulder joint rehabilitation assistive device in FIG. 1.

With reference to FIGS. 2, 5, and 6, the upper limb adaptive mechanism 6 comprises a moving member 61, a supporting frame 62, and a limb connecting member 63. The moving member 61 is moveably mounted on the upper limb connecting mechanism 4. Preferably, the upper lever 411 of the upper limb connecting mechanism 4 may have a rail 414. The moving member 61 has a sliding block 611 mounted on a side of the moving member 61 and slidably mounted on the rail 414 on the upper lever 411. Accordingly, the moving member 61 can be moved along the rail on the upper lever 411. The supporting frame 62 may be mounted securely or rotatably on the moving member 61 by an axle 620 and has at least one curved rail 621. The limb connecting member 63 is mounted moveably in curved on the at least one curved rail 621 of the supporting frame 62 and is adapted to connect with the upper limb of the user.

Preferably, the moving member 61 is L-shaped. The supporting frame 62 comprises two panels 622 and a bottom panel 624. The at least one curved rail 621 is mounted on tops of the panels 622. Each panel 622 further has a curved groove 623 defined in the panel 622 at a side facing the curved groove 623 of the other panel 622. The bottom panel 624 is connected with bottoms of the side panels, and the axle 620 is mounted on a bottom surface of the bottom panel 624 and is rotatably connected with the moving member 61.

The limb connecting member 63 comprises a curved connecting board 631 and multiple rotating wheels 632. The connecting board 631 is mounted on the tops of the panels 622 of the supporting frame 62. The rotating wheels 632 are mounted on a bottom and two sides of the connecting board 631 and are mounted on the at least one curved rail 621 and in the curved grooves 623. Accordingly, the limb connecting member 63 can be moved along the at least one curved rail 621 and the curved grooves 623. In use, the upper limb of the user is put on the curved connecting board 631 and is secured by elastic belts, adhesive straps or fastening straps to hold the upper limb on the connecting board 631.

With reference to FIGS. 1 and 4, the shoulder joint rehabilitation assistive device may further comprise a static balance mechanism 5 connected with the lower lever 412 of the upper limb connecting mechanism 4. The static balance mechanism 5 comprises a base tube 50, a stiffness-variable resilient element 51, a wheel 52, a connecting rope 53, and an adjustment element 54. The base tube 50 is mounted securely on the lower lever 412 of the upper limb connecting mechanism 4. The stiffness-variable resilient element 51 is mounted in the base tube 50. The wheel 52 is mounted rotatably on the lower portion of the linking rod 30 and is located above the end of the lower lever 411 that is pivotally connected with the lower portion of the linking rod 30. The connecting rope 53 is mounted around the wheel 52 and has two ends connected respectively with the stiffness-variable resilient element 51 and the lower lever 412. The adjustment element 54 is mounted on the base tube 50 and is connected with the stiffness-variable resilient element 51 to adjust a pre-pulling force of the stiffness-variable resilient element 51. Accordingly, the static balance mechanism 5 can provide a balance torque to offset the weight of the upper limb of the user and to reduce the load applied to the actuating mechanism 2. The stiffness of the stiffness-variable resilient element 51 can be changed to fit with different users' upper limbs and to balance the loads due to the upper limbs of different weights.

Preferably, the stiffness-variable resilient element 51 comprises an extension spring 511 and a connection block 512. One end of the extension spring 511 is connected with the connecting rope 53, and the connection block 512 is mounted on the other end of the extension spring 511. The adjustment element 54 is connected with the connection block 512. Accordingly, when the position of the connection block 512 is changed, the extension spring 511 is compressed or released. Thus, the pre-pulling force of the extension spring 511 can be adjusted.

Figure 7:
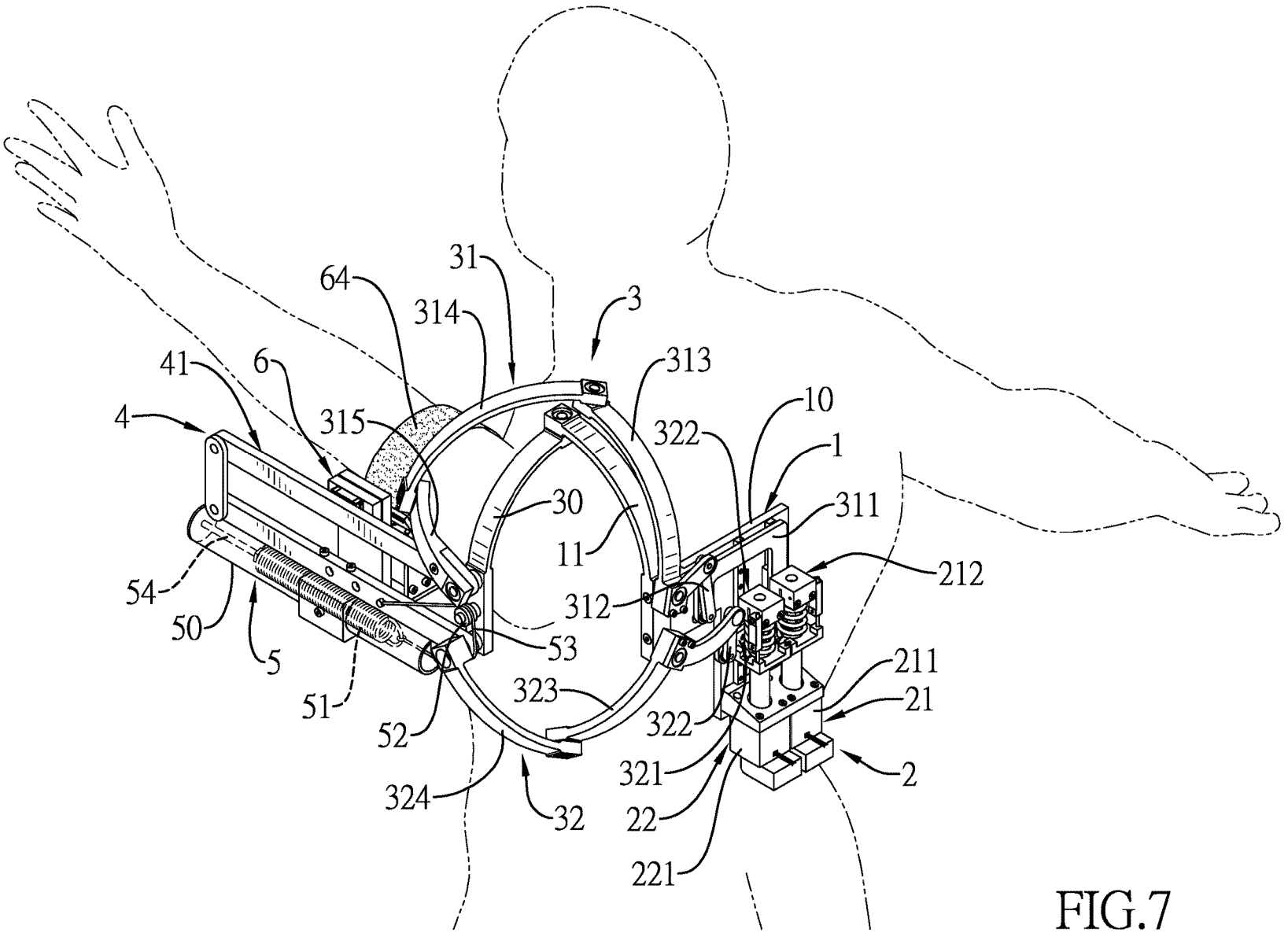
FIG. 7 is an operational perspective view of the shoulder joint rehabilitation assistive device in FIG. 1.
Figure 8:
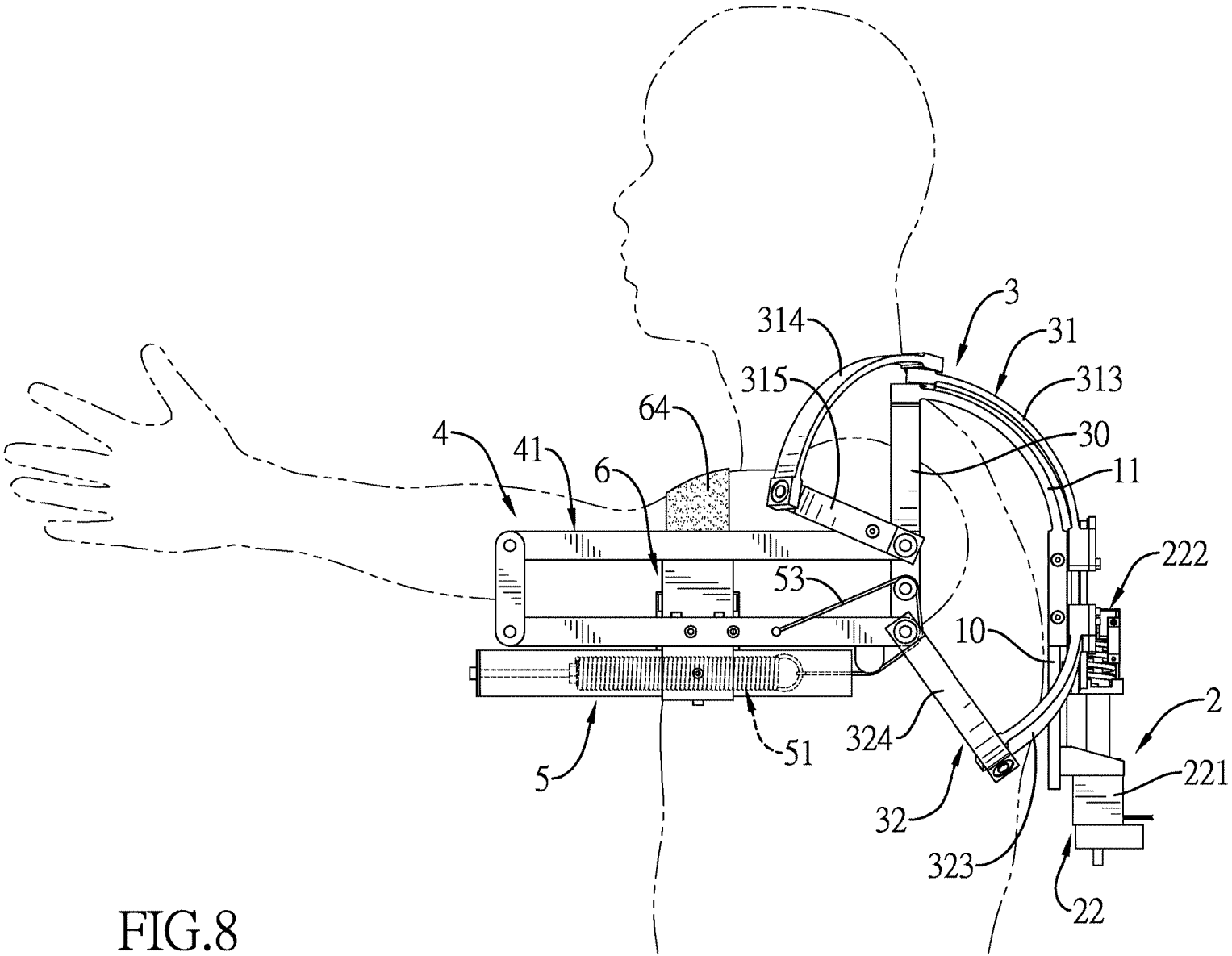
FIG. 8 is an operational side view of the shoulder joint rehabilitation assistive device in FIG. 7.
Figure 9:
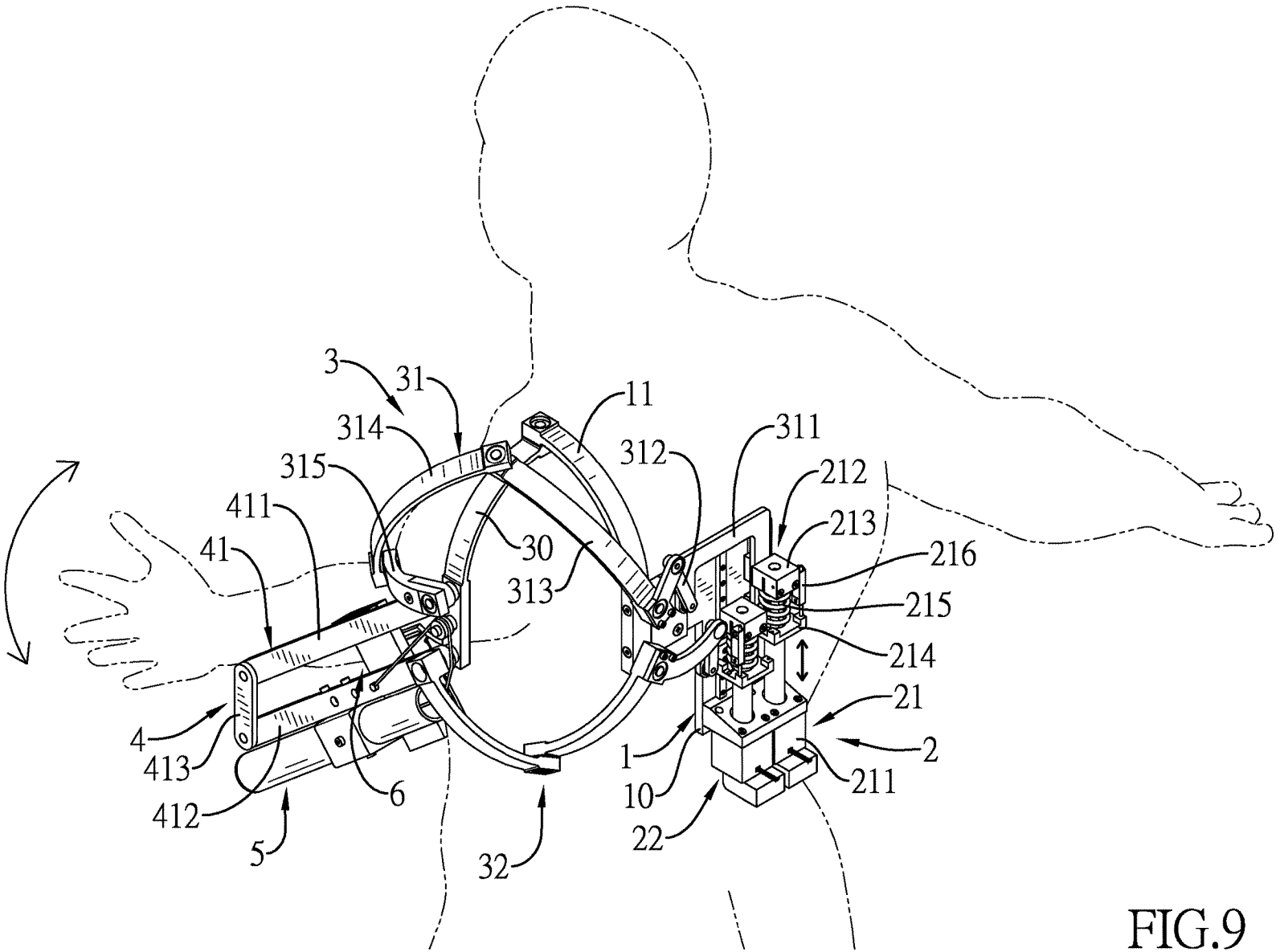
FIG. 9 is another operational perspective view of the shoulder joint rehabilitation assistive device in FIG. 1.
Figure 10:
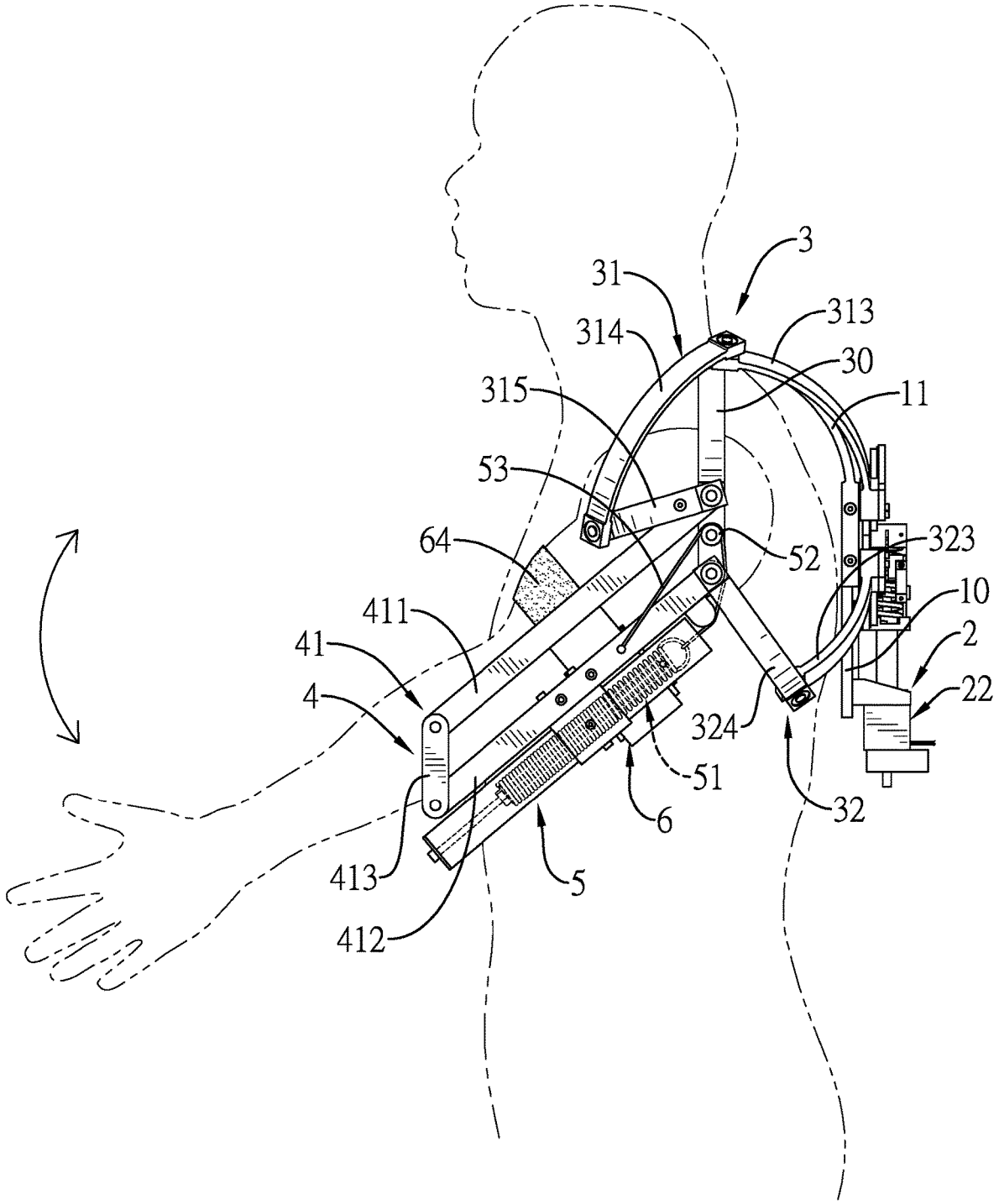
FIG. 10 is an operational side view of the shoulder joint rehabilitation assistive device in FIG. 9.
Figure 11:
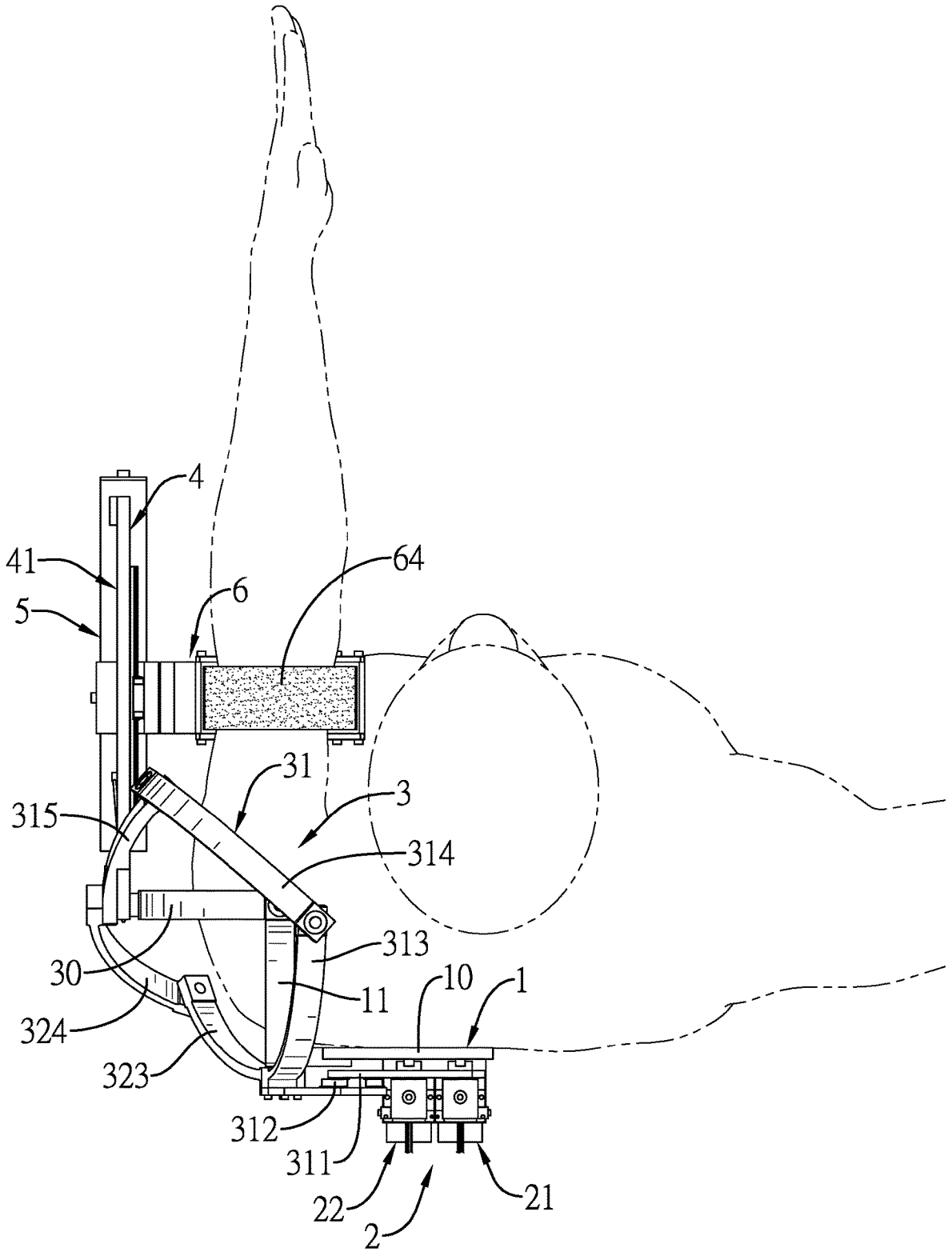
FIG. 11 is an operational top view of the shoulder joint rehabilitation assistive device in FIG. 9.
Figure 12:
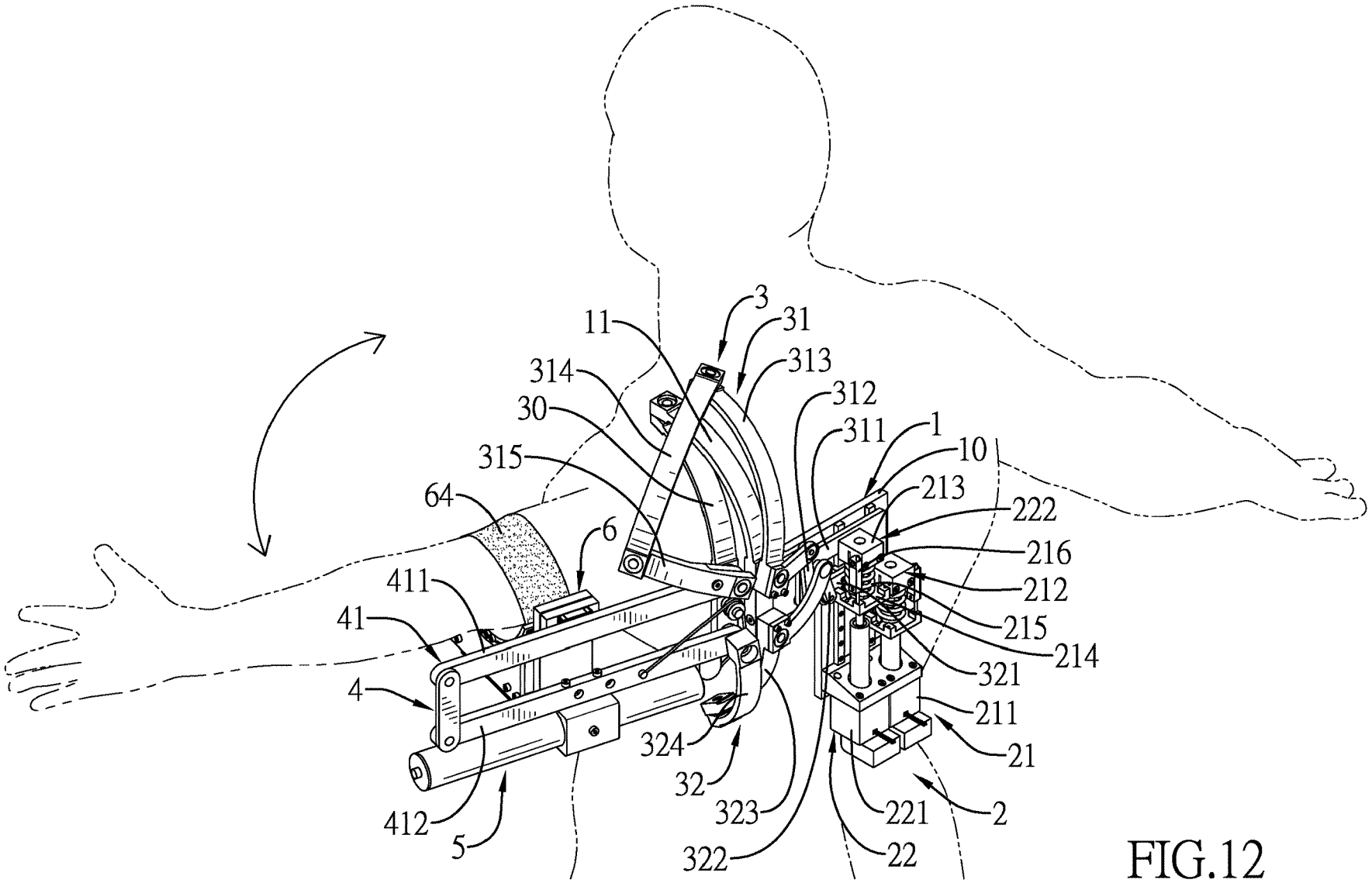
FIG. 12 is another operational perspective view of the shoulder joint rehabilitation assistive device in FIG. 1.
Figure 13:
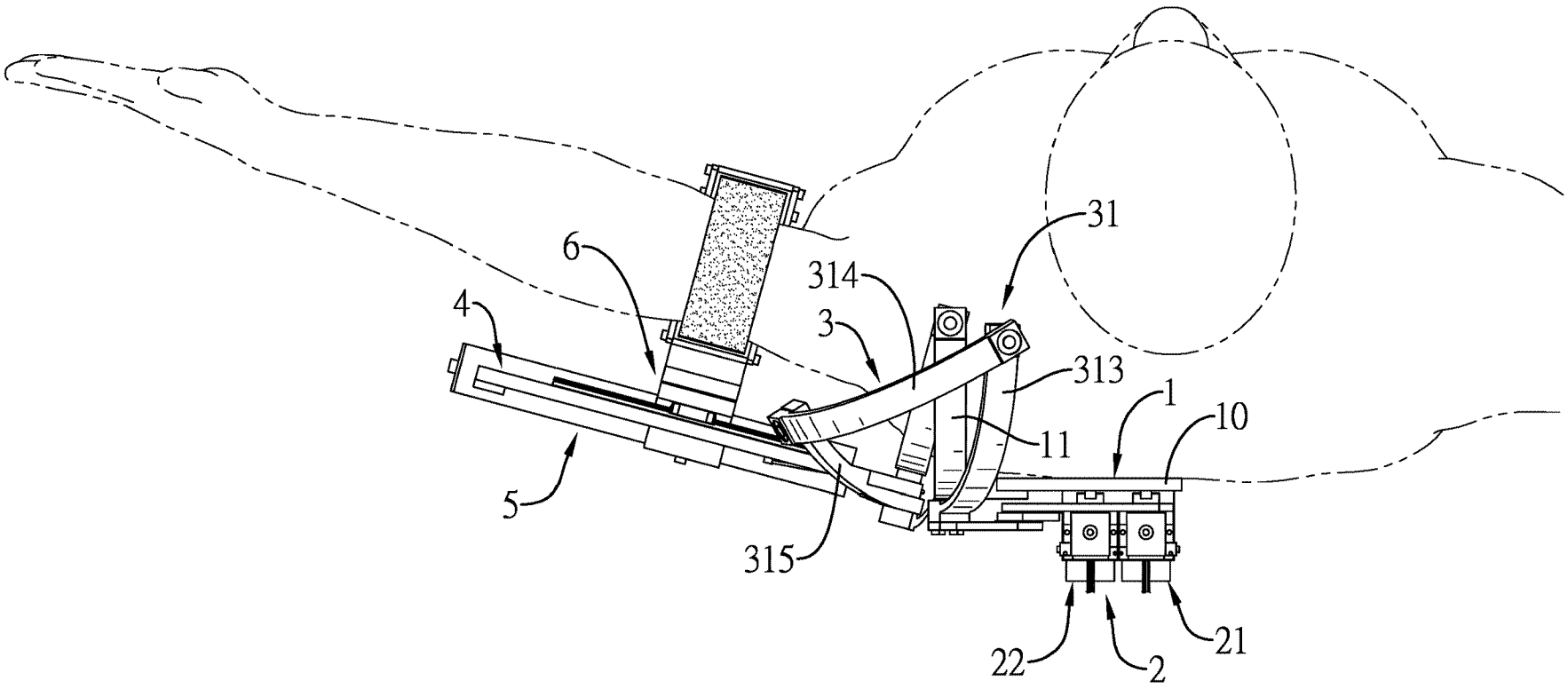
FIG. 13 is an operational top view of the shoulder joint rehabilitation assistive device in FIG. 12.

The shoulder joint rehabilitation assistive device in accordance with the present invention can be applied to assist a person disabled in the upper limbs to rehabilitate or to augment the strength of the upper limbs of a person who works in a labor-intensive condition. With reference to FIGS. 2, 7, and 8, the exoskeleton base 1 is attached securely to a back of a user with belts, and the spherical mechanism 3 is adjacent to the shoulder of the user. The upper limb of the user is put and secured on the connecting board 631 of the limb connecting member 63 of the upper limb adaptive mechanism 6 with belts or straps.

Accordingly, the upper limb of the user can be controlled to move along a route set up by a computer and via the transmission of the spherical yaw linking assembly 31 and the spherical pitch linking assembly 32 of the spherical mechanism 3 driven by the first linear actuator 211 of the yaw spring actuating assembly 21 and the second linear actuator 221 of the pitch spring actuating assembly 22 of the actuating mechanism 2. Thus, the user can move the upper limb without physically applying any force, and this can be applied to an initial stage of rehabilitation in a passive mode.

With reference to FIGS. 7 to 10, the upper limb of the user can be moved outward and inward along a vertical direction with the transmission of the spherical yaw linking assembly 31, the linking rod 30, and the upper limb connecting mechanism 4 driven by the yaw spring actuating assembly 21 of the actuating mechanism 2. With reference to FIGS. 7 and 11 to 13, the upper limb of the user can be moved outward and inward along a horizontal direction with the transmission of the spherical pitch linking assembly 32, the linking rod 30, and the upper limb connecting mechanism 4 driven by the pitch spring actuating assembly 22 of the actuating mechanism 2. Alternatively, the upper limb of the user can be moved outward and inward along the vertical and horizontal directions simultaneously with the transmission of the spherical yaw linking assembly 31, the spherical pitch linking assembly 32, the linking rod 30, and the upper limb connecting mechanism 4 driven by the yaw spring actuating assembly 21 and the pitch spring actuating assembly 22 of the actuating mechanism 2.

With reference to FIGS. 7 and 8, the shoulder joint rehabilitation assistive device in accordance with the present invention can be applied to move the upper limb of the user in cooperation with the force provided by the user with the transmission of the spherical yaw linking assembly 31 and/or the spherical pitch linking assembly 32 driven by the yaw spring actuating assembly 21 and/or the pitch spring actuating assembly 22 of the actuating mechanism 2. With the series connections between the first linear actuating portion of the first linear actuator 211, the first spring actuating portion 212, and the spherical yaw linking assembly 31 and between the second linear actuating portion of the second linear actuator 221, the second spring actuating portion 222, and the spherical pitch linking assembly 32, the user can exercise the upper limb with the force exerted by the user in different resistances. Thus, the shoulder joint rehabilitation assistive device can provide the user with an initiative exercising effect. When the resistance is too large, the resistance can be adjusted to improve the safety and compliance of using the device.

With such an arrangement, the shoulder joint rehabilitation assistive device can be operated in an initiative or a passive mode. Thus, the user can use the shoulder joint rehabilitation assistive device in the initiative mode first, and the computer can record the route of the movement of the upper limb in the initiative mode. Then, the upper limb can be moved along the route of the movement recorded in the computer in a passive mode to assist the user to rehabilitate the upper limb in a repeated route.

Moreover, the upper limb adaptive mechanism allows the upper limb of the user to move or rotate freely, such that the use of the shoulder joint rehabilitation assistive device in accordance with the present invention is comfortable. In addition, the static balance mechanism 5 can provide a balance torque to offset the weight of the upper limb of the user, and the shoulder joint rehabilitation assistive device can assist the user to rehabilitate or to augment the strength of the upper limb of the user.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shoulder joint rehabilitation assistive device comprising:

an exoskeleton base comprising a securing board and an arm disposed on the securing board;

an actuating mechanism mounted on the securing board of the exoskeleton base and comprising a yaw spring actuating assembly mounted on the securing board and comprising a first linear actuator having a first linear actuating portion; and a first spring actuating portion connected with the first linear actuating portion in series; and a pitch spring actuating assembly mounted on the securing board and comprising a second linear actuator having a second linear actuating portion; and a second spring actuating portion connected with the first linear actuating portion in series;

a spherical mechanism connected with the actuating mechanism and comprising a linking rod connected pivotally with the arm of the exoskeleton base;

a spherical yaw linking assembly having two ends, wherein one of the two ends of the spherical yaw linking assembly is provided with a first yaw actuating portion, and the other one of the two ends of the spherical yaw linking assembly is provided with a second yaw actuating portion, the first yaw actuating portion is connected with the first spring actuating portion of the yaw spring actuating assembly in series, and the second yaw actuating portion is pivotally connected with a lower portion of the linking rod; and a spherical pitch linking assembly disposed below the spherical yaw linking assembly and having two ends, wherein one of the two ends of the spherical pitch linking assembly is provided with a first pitch actuating portion, and the other one of the two ends of the spherical pitch linking assembly is provided with a second pitch actuating portion, the first pitch actuating portion is connected with the second spring actuating portion of the pitch spring actuating assembly in series, and the second pitch actuating portion is pivotally connected with the lower portion of the linking rod; and an upper limb connecting mechanism connected with the linking rod and the second yaw actuating portion of the spherical yaw linking assembly.

2. The shoulder joint rehabilitation assistive device as claimed in claim 1, wherein the first linear actuator of the yaw spring actuating assembly is a linear motor;

the first linear actuating portion is capable of moving upward and downward;

the first spring actuating portion comprises a first actuating block connected securely with the first linear actuating portion of the first linear actuator;

a first driving block through which the first linear actuating portion is mounted below the first actuating block and connected securely with the first spring actuating portion of the yaw spring actuating assembly; and a first spring mounted between the first actuating block and the first driving block and mounted around the first linear actuating portion;

the second linear actuator of the pitch spring actuating assembly is juxtaposed to the first linear actuator of the yaw spring actuating assembly;

the second linear actuator of the pitch spring actuating assembly is a linear motor;

the second linear actuating portion is capable of moving upward and downward;

the second spring actuating portion comprises a second actuating block connected securely with the second linear actuating portion of the second linear actuator;

a second driving block through which the second linear actuating portion is mounted below the second actuating block and connected securely with the second spring actuating portion of the pitch spring actuating assembly; and a second spring mounted between the second actuating block and the second driving block and mounted around the second linear actuating portion.

3. The shoulder joint rehabilitation assistive device as claimed in claim 2, wherein the yaw spring actuating assembly further comprises a first movement sensor mounted on the first spring actuating portion to detect a degree of deformation of the first spring; and the pitch spring actuating assembly further comprises a second movement sensor mounted on the second spring actuating portion to detect a degree of deformation of the second spring.

4. The shoulder joint rehabilitation assistive device as claimed in claim 3, wherein the arm of the exoskeleton base and the linking rod are curved;

the spherical yaw linking assembly comprises a first yaw lever, a second yaw lever, a third yaw lever, a fourth yaw lever, and a fifth yaw lever pivotally connected with each other in series;

the fourth yaw lever and the fifth yaw lever are curved;

the first yaw lever is mounted upward and downward moveably on the securing board of the exoskeleton base;

the first yaw actuating portion is defined at an end of the first yaw lever opposite the second yaw lever;

the third yaw lever is L-shaped and has a bent segment pivotally connected with the securing board at a position adjacent to the arm;

the second yaw actuating portion is defined at an end of the fifth yaw lever opposite the fourth yaw lever;

the spherical pitch linking assembly comprises a first pitch lever, a second pitch lever, a third pitch lever, and a fourth pitch lever pivotally connected with each other in series;

the fourth pitch lever is curved and is below the arm and the linking rod;

the first pitch lever is mounted upward and downward moveably on the securing board of the exoskeleton base;

the first pitch actuating portion is defined at an end of the first pitch lever opposite the second pitch lever;

the third pitch lever is L-shaped and has a bent segment bent reversely relative to the third yaw lever;

the bent segment of the third pitch lever is pivotally connected with the securing board at a position adjacent to the arm and is located below the bent segment of the third yaw lever; and the second pitch actuating portion is defined at an end of the fourth pitch lever opposite the third pitch lever.

5. The shoulder joint rehabilitation assistive device as claimed in claim 4, wherein the upper limb connecting mechanism comprises an upper limb connecting lever assembly; and the upper limb connecting lever assembly comprises an upper lever having an end connected securely with the second yaw actuating portion of the spherical yaw linking assembly and pivotally connected with the lower portion of the linking rod at a position where the second yaw actuating portion is pivotally connected with the lower portion of the linking rod;

a lower lever being parallel with the upper lever and having an end pivotally connected with the lower portion of the linking rod at a position where the second pitch actuating portion is pivotally connected with the lower portion of the linking rod; and a side lever pivotally connected between the upper lever and the lower lever in series.

6. The shoulder joint rehabilitation assistive device as claimed in claim 5 further comprising a static balance mechanism connected with the upper limb connecting mechanism and comprising a base tube mounted securely on the lower lever of the upper limb connecting mechanism;

a stiffness-variable resilient element mounted in the base tube;

a wheel mounted rotatably on the lower portion of the linking rod and located above the end of the lower lever that is pivotally connected with the lower portion of the linking rod;

a connecting rope mounted around the wheel and having two ends connected respectively with the stiffness-variable resilient element and the lower lever; and an adjustment element mounted on the base tube and connected with the stiffness-variable resilient element to adjust a pre-pulling force of the stiffness-variable resilient element.

7. The shoulder joint rehabilitation assistive device as claimed in claim 6 further comprising an upper limb adaptive mechanism moveably connected with the upper lever of the upper limb connecting mechanism, wherein the upper limb adaptive mechanism comprises a moving member comprising a sliding block moveably mounted on the upper lever of the upper limb connecting mechanism;

a supporting frame mounted on the moving member and having a curved rail; and a limb connecting member moveably mounted on the curved rail of the supporting frame.

8. The shoulder joint rehabilitation assistive device as claimed in claim 3, wherein the upper limb connecting mechanism comprises an upper limb connecting lever assembly; and the upper limb connecting lever assembly comprises an upper lever having an end connected securely with the second yaw actuating portion of the spherical yaw linking assembly and pivotally connected with the lower portion of the linking rod at a position where the second yaw actuating portion is pivotally connected with the lower portion of the linking rod;

a lower lever being parallel with the upper lever and having an end pivotally connected with the lower portion of the linking rod at a position where the second pitch actuating portion is pivotally connected with the lower portion of the linking rod; and a side lever pivotally connected between the upper lever and the lower lever in series.

9. The shoulder joint rehabilitation assistive device as claimed in claim 8 further comprising a static balance mechanism connected with the upper limb connecting mechanism and comprising a base tube mounted securely on the lower lever of the upper limb connecting mechanism;

a stiffness-variable resilient element mounted in the base tube;

a wheel mounted rotatably on the lower portion of the linking rod and located above the end of the lower lever that is pivotally connected with the lower portion of the linking rod;

a connecting rope mounted around the wheel and having two ends connected respectively with the stiffness-variable resilient element and the lower lever; and an adjustment element mounted on the base tube and connected with the stiffness-variable resilient element to adjust a pre-pulling force of the stiffness-variable resilient element.

10. The shoulder joint rehabilitation assistive device as claimed in claim 9 further comprising an upper limb adaptive mechanism moveably connected with the upper lever of the upper limb connecting mechanism, wherein the upper limb adaptive mechanism comprises a moving member comprising a sliding block moveably mounted on the upper lever of the upper limb connecting mechanism;

a supporting frame mounted on the moving member and having a curved rail; and a limb connecting member moveably mounted on the curved rail of the supporting frame.

11. The shoulder joint rehabilitation assistive device as claimed in claim 8 further comprising an upper limb adaptive mechanism moveably connected with the upper lever of the upper limb connecting mechanism.

12. The shoulder joint rehabilitation assistive device as claimed in claim 5 further comprising an upper limb adaptive mechanism moveably connected with the upper lever of the upper limb connecting mechanism.

13. The shoulder joint rehabilitation assistive device as claimed in claim 1, wherein the arm of the exoskeleton base and the linking rod are curved;

the spherical yaw linking assembly comprises a first yaw lever, a second yaw lever, a third yaw lever, a fourth yaw lever, and a fifth yaw lever pivotally connected with each other in series;

the fourth yaw lever and the fifth yaw lever are curved;

the first yaw lever is mounted upward and downward moveably on the securing board of the exoskeleton base;

the first yaw actuating portion is defined at an end of the first yaw lever opposite the second yaw lever;

the third yaw lever is L-shaped and has a bent segment pivotally connected with the securing board at a position adjacent to the arm;

the second yaw actuating portion is defined at an end of the fifth yaw lever opposite the fourth yaw lever;

the spherical pitch linking assembly comprises a first pitch lever, a second pitch lever, a third pitch lever, and a fourth pitch lever pivotally connected with each other in series;

the fourth pitch lever is curved and is below the arm and the linking rod;

the first pitch lever is mounted upward and downward moveably on the securing board of the exoskeleton base;

the first pitch actuating portion is defined at an end of the first pitch lever opposite the second pitch lever;

the third pitch lever is L-shaped and has a bent segment bent reversely relative to the third yaw lever;

the bent segment of the third pitch lever is pivotally connected with the securing board at a position adjacent to the arm and is located below the bent segment of the third yaw lever; and the second pitch actuating portion is defined at an end of the fourth pitch lever opposite the third pitch lever.

14. The shoulder joint rehabilitation assistive device as claimed in claim 13, wherein the upper limb connecting mechanism comprises an upper limb connecting lever assembly; and the upper limb connecting lever assembly comprises an upper lever having an end connected securely with the second yaw actuating portion of the spherical yaw linking assembly and pivotally connected with the lower portion of the linking rod at a position where the second yaw actuating portion is pivotally connected with the lower portion of the linking rod;

a lower lever being parallel with the upper lever and having an end pivotally connected with the lower portion of the linking rod at a position where the second pitch actuating portion is pivotally connected with the lower portion of the linking rod; and a side lever pivotally connected between the upper lever and the lower lever in series.

15. The shoulder joint rehabilitation assistive device as claimed in claim 14 further comprising a static balance mechanism connected with the upper limb connecting mechanism and comprising a base tube mounted securely on the lower lever of the upper limb connecting mechanism;

a stiffness-variable resilient element mounted in the base tube;

a wheel rotatably mounted on the lower portion of the linking rod and located above the end of the lower lever that is pivotally connected with the lower portion of the linking rod;

a connecting rope mounted around the wheel and having two ends connected respectively with the stiffness-variable resilient element and the lower lever; and an adjustment element mounted on the base tube and connected with the stiffness-variable resilient element to adjust a pre-pulling force of the stiffness-variable resilient element.

16. The shoulder joint rehabilitation assistive device as claimed in claim 15 further comprising an upper limb adaptive mechanism moveably connected with the upper lever of the upper limb connecting mechanism, wherein the upper limb adaptive mechanism comprises a moving member moveably mounted on the upper lever of the upper limb connecting mechanism;

a supporting frame mounted on the moving member and having a curved rail; and a limb connecting member moveably mounted on the curved rail of the supporting frame.

17. The shoulder joint rehabilitation assistive device as claimed in claim 14 further comprising an upper limb adaptive mechanism moveably connected with the upper lever of the upper limb connecting mechanism.

18. The shoulder joint rehabilitation assistive device as claimed in claim 1, wherein the upper limb connecting mechanism comprises an upper limb connecting lever assembly; and the upper limb connecting lever assembly comprises an upper lever having an end connected securely with the second yaw actuating portion of the spherical yaw linking assembly and pivotally connected with the lower portion of the linking rod at a position where the second yaw actuating portion is pivotally connected with the lower portion of the linking rod;

a lower lever being parallel with the upper lever and having an end pivotally connected with the lower portion of the linking rod at a position where the second pitch actuating portion is pivotally connected with the lower portion of the linking rod; and a side lever pivotally connected between the upper lever and the lower lever in series.

19. The shoulder joint rehabilitation assistive device as claimed in claim 18 further comprising a static balance mechanism connected with the upper limb connecting mechanism and comprising a base tube mounted securely on the lower lever of the upper limb connecting mechanism;

a stiffness-variable resilient element mounted in the base tube;

a wheel rotatably mounted on the lower portion of the linking rod and located above the end of the lower lever that is pivotally connected with the lower portion of the linking rod;

a connecting rope mounted around the wheel and having two ends connected respectively with the stiffness-variable resilient element and the lower lever; and an adjustment element mounted on the base tube and connected with the stiffness-variable resilient element to adjust a pre-pulling force of the stiffness-variable resilient element.

20. The shoulder joint rehabilitation assistive device as claimed in claim 19 further comprising an upper limb adaptive mechanism moveably connected with the upper lever of the upper limb connecting mechanism, wherein the upper limb adaptive mechanism comprises a moving member comprising a sliding block moveably mounted on the upper lever of the upper limb connecting mechanism;

a supporting frame mounted on the moving member and having a curved rail; and a limb connecting member moveably mounted on the curved rail of the supporting frame.

* * * * *